US006727659B2

(12) United States Patent
Kim et al.

(10) Patent No.: US 6,727,659 B2
(45) Date of Patent: Apr. 27, 2004

(54) APPARATUS AND METHOD FOR DRIVING PLASMA DISPLAY PANELS

(75) Inventors: Jae-Yeol Kim, Asan (KR); Jin-Sung Kim, Anyang (KR); Jun-Hyung Kim, Asan (KR); Kazuhiro Ito, Cheonan (KR); Myeong-Seob So, Bucheon (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 10/431,162

(22) Filed: May 6, 2003

(65) Prior Publication Data

US 2003/0222591 A1 Dec. 4, 2003

(30) Foreign Application Priority Data

May 30, 2002 (KR) ..... 10-2002-0030324

(51) Int. Cl.[7] ..... G09G 3/10; G09G 3/30

(52) U.S. Cl. ..... 315/169.1; 315/169.4; 345/76; 345/77; 345/90; 345/60

(58) Field of Search ..... 315/169.1, 169.3, 315/169.4; 345/55, 60, 63, 66–68, 76, 77, 87, 90

(56) References Cited

U.S. PATENT DOCUMENTS 4,866,349 A 9/1989 Weber et al.
5,081,400 A 1/1992 Weber et al.
2003/0057854 A1 * 3/2003 Roh ..... 315/169.3
2003/0090440 A1 * 5/2003 Marcotte ..... 345/60

* cited by examiner

*Primary Examiner*—Tuyet T. Vo
(74) *Attorney, Agent, or Firm*—Christie, Parker & Hale, LLP

(57) ABSTRACT

An apparatus for driving a plasma display panel that includes first and second signal lines for supplying first and second voltages, respectively, and first and second inductors coupled to one terminal of a panel capacitor. A first current path is formed from the panel capacitor to the second signal line via the second inductor to drop the voltage of the panel capacitor from the first voltage to the second voltage. A second current path is formed to recover the current flowing to the second inductor towards the first signal line, while the voltage of the panel capacitor is sustained at the second voltage. A third current path is formed from the first signal line to the panel capacitor via the first inductor while the current flowing to the second inductor is recovered, to raise the voltage of the panel capacitor from the second voltage to the first voltage. A fourth current is also formed to recover the current flowing to the first inductor towards the first signal line, while the voltage of the panel capacitor is sustained at the first voltage.

20 Claims, 8 Drawing Sheets

APPARATUS AND METHOD FOR DRIVING PLASMA DISPLAY PANELS

CROSS REFERENCE TO RELATED APPLICATION

This application claims priority to and the benefit of Korean Patent Application No. 2002-0030324 filed on May 30, 2002 in the Korean Intellectual Property Office, the content of which is incorporated herein by reference.

BACKGROUND OF THE INVENTION (a) Field of the Invention

The present invention relates to an apparatus and method for driving a plasma display panel. More specifically, the present invention relates to an address driver circuit for a plasma display panel.

(b) Description of the Related Art

In recent years, flat panel displays such as a liquid crystal display (LCD), a field emission display (FED), a plasma display panel (PDP), and the like have been actively developed. The PDP is advantageous over the other flat panel displays in regard to its high luminance, high luminous efficiency, and wide view angle, and accordingly, it is favorable for making a large-scale screen of more than 40 inches as a substitute for the conventional cathode ray tube (CRT).

The PDP is a flat panel display that uses plasma generated by gas discharge to display characters or images and includes, according to its size, more than several scores to millions of pixels arranged in a matrix pattern. Such a PDP is classified into a direct current (DC) PDP and an alternating current (AC) PDP according to its discharge cell structure and the waveform of the driving voltage applied thereto.

The DC PDP has electrodes exposed to a discharge space to allow DC to flow through the discharge space while voltage is applied, and thus requires a resistance for limiting the current. Contrarily, the AC PDP has electrodes covered with a dielectric layer that naturally form a capacitance component to limit the current and to protect the electrodes from the impact of ions during discharge, and is thus superior to the DC PDP in regard to long lifetime.

Typically, the driving method of the AC PDP is composed of a reset (initialization) step, an addressing (write) step, a sustain discharge step, and an erase step.

In the reset step, the state of each cell is initialized in order to readily perform an addressing operation on the cell. In the write step, wall charges are formed on selected "on"-state cells (i.e., addressed cells) in the panel. In the sustain step, a discharge occurs to actually display an image on the addressed cells. In the erase step, the wall charges on the cells are erased to end the sustain discharge.

In the AC PDP, the panel between address, sustain, and scan electrodes acts as a capacitance load and is therefore called a panel capacitor. Due to the capacitance of the panel capacitor, there is a need for a reactive power in order to apply a waveform for addressing or sustain discharge. A circuit for recovering the reactive power and reusing it is called a "power recovery circuit", some of which have been suggested by L. F. Weber (in U.S. Pat. Nos. 4,866,349 and 5,081,400).

With the conventional power recovery circuit mounted on an address buffer board, a parasitic inductance component $L_p$ as shown in FIG. 1 may be caused by the output pattern 10 running in the lengthwise direction of the address buffer board. In FIG. 1, the circuit on the left side of parasitic inductance component $L_p$ is a power recovery circuit proposed by Weber, and capacitor $C_p$ is a panel capacitor functioning as a capacitive load.

In detail, there is a need for a plurality of address-driving ICs in order to drive address electrodes, because all the address electrodes cannot be coupled to a single address-driving IC. With the plural address-driving ICs coupled to one power recovery circuit, a parasitic inductance component may be formed on the output pattern in which the address-driving ICs are coupled to the address buffer board. The parasitic inductance component causes an extreme distortion of the address-driving waveform. Namely, an undesired pulse rise may occur in the rise/drop interval of the address-driving waveform because of the parasitic inductance component.

SUMMARY OF THE INVENTION

In accordance with the present invention a power recovery circuit recovers a reactive power necessary for address driving and minimizes the effect of a parasitic inductance component existing in an address driver circuit. Energy is stored in both inductors and parasitic inductance components. First and second inductors have one terminal thereof coupled to both terminals of a path coupled to one terminal of a panel capacitor.

In a first aspect of the present invention, there is provided an apparatus for driving a PDP. A first switch and a first capacitor are coupled in series between the other terminal of the first inductor and a first power source supplying a first voltage. A second switch and a second capacitor are coupled in series between the other terminal of the second inductor and the first power source. A third switch is coupled between a second power source for supplying a second voltage and the one terminal of the first inductor. A fourth switch is coupled between the one terminal of the second inductor and the first power source. The first and second capacitors are charged to a voltage substantially corresponding to half of the second voltage. Preferably, a parasitic inductance component is formed on the path. The apparatus further includes first and second diodes respectively formed on a path including the first switch and the first inductor and a path including the second switch and the second inductor. The apparatus further includes a first diode coupled between the first power source and the other terminal of the first inductor, and a second diode coupled between the other terminal of the second inductor and the second power source. Preferably, the third and fourth switches have a body diode.

In a second aspect of the present invention, there is also provided an apparatus for driving a PDP. A first voltage changer changes the terminal voltage of the panel capacitor to a second voltage using the energy stored in a first inductor and a resonance. A second voltage changer changes the terminal voltage of the panel capacitor to the first voltage using the energy stored in a second inductor and the resonance. A power supply section includes first and second power sources, the first power source supplying the first voltage and sustaining the terminal voltage of the panel capacitor at the first voltage, the second power source supplying the second voltage and sustaining the terminal voltage of the panel capacitor at the second voltage. The energy is stored in the first inductor through a current path formed from the first inductor to one terminal of the panel capacitor, while a terminal voltage of the panel capacitor is sustained at a first voltage. Further, the energy is stored in the second inductor through a current path formed from one terminal of the panel capacitor to the second inductor, while the terminal voltage of the panel capacitor is sustained at the second voltage. Preferably, the apparatus further includes first and second capacitors charged to a third voltage substantially corresponding to half of the difference between the second voltage and the first voltage. The apparatus further includes a first switch being coupled between the first inductor and the first capacitor and performing a switching operation to flow a current to the first inductor; and a second switch being coupled between the second inductor and the second capacitor and performing a switching operation to flow a current to the second inductor. Preferably, the apparatus includes a first path for recovering a current flowing to the first inductor, and a second path for recovering a current flowing to the second inductor. The first voltage changer further includes a switch performing a switching operation to sustain the terminal voltage of the panel capacitor at the second voltage and having a body diode through which a current flowing to the first inductor is recovered. Likewise, the second voltage changer further includes a switch performing a switching operation to sustain the terminal voltage of the panel capacitor at the first voltage and having a body diode through which a current flowing to the second inductor is recovered.

In a third aspect of the present invention, there is provided a method for driving a PDP. Energy is stored in a first inductor coupled to one terminal of a path coupled to one terminal of the panel capacitor, while a terminal voltage of the panel capacitor is sustained at a first voltage. The terminal voltage of the panel capacitor is changed to a second voltage using the energy stored in the first inductor and a resonance. A current flowing to the first inductor is recovering while sustaining the terminal voltage of the panel capacitor at the second voltage. Energy is stored in a second inductor coupled to the other terminal of the path, while the terminal voltage of the panel capacitor is sustained at the second voltage. The terminal voltage of the panel capacitor is changed to the first voltage using the energy stored in the second inductor and the resonance. A current flowing to the second inductor is recovered while sustaining the terminal voltage of the panel capacitor at the first voltage. In storing the energy in the first inductor, there is used a first capacitor charged to a third voltage substantially corresponding to half of the difference between the second voltage and the first voltage. In storing the energy in the second inductor, the difference between the second voltage and the third voltage charged on the second capacitor is used. Preferably, the terminal voltage of the panel capacitor is sustained at the second voltage using a power source for supplying the second voltage, and a current flowing to the first inductor is recovered through a path formed between the first inductor and the power source. Preferably, the terminal voltage of the panel capacitor is sustained at the first voltage using a power source for supplying the first voltage, and a current flowing to the second inductor is recovered through a path formed between the power source and the second inductor.

In a fourth aspect of the present invention, there is further provided an apparatus for driving a PDP. A panel capacitor is coupled on a lengthwise conductive pattern and an address-driving waveform is applied to the panel capacitor. The apparatus includes first and second inductors each having one terminal thereof coupled to both terminals of the conductive pattern. Here, a first current path is formed to flow a first current through the first inductor and the conductive pattern. A second current path is formed to cause a resonance of the first inductor and the panel capacitor while the first current flows, thereby changing a voltage of the panel capacitor to a first voltage due to the resonance. A third current path is formed to recover a current remaining in the first inductor, while the voltage of the panel capacitor is sustained at the first voltage. A fourth current path is then formed to flow a second current through the conductive pattern and the second inductor. A fifth current path is formed to cause a resonance of the second inductor and the panel capacitor while the second current flows, thereby changing the voltage of the panel capacitor to a second voltage due to the resonance. A sixth current path is formed to recover a current remaining in the second inductor while the voltage of the panel capacitor is sustained at the second voltage.

DETAILED DESCRIPTION

Figure 1:
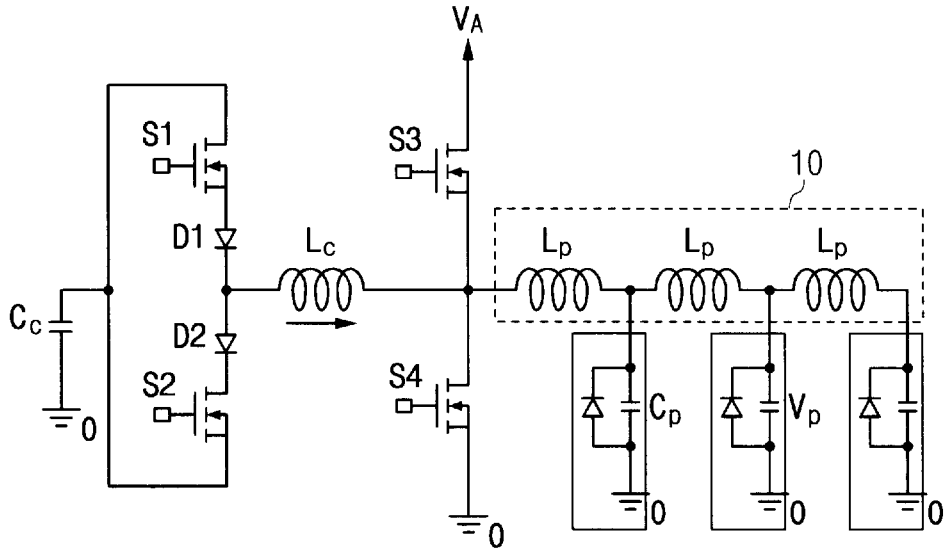
Fig. 1 (Prior Art)
FIG. 1 is an illustration of a parasitic inductance component in a power recovery circuit according to prior art.
Figure 2:
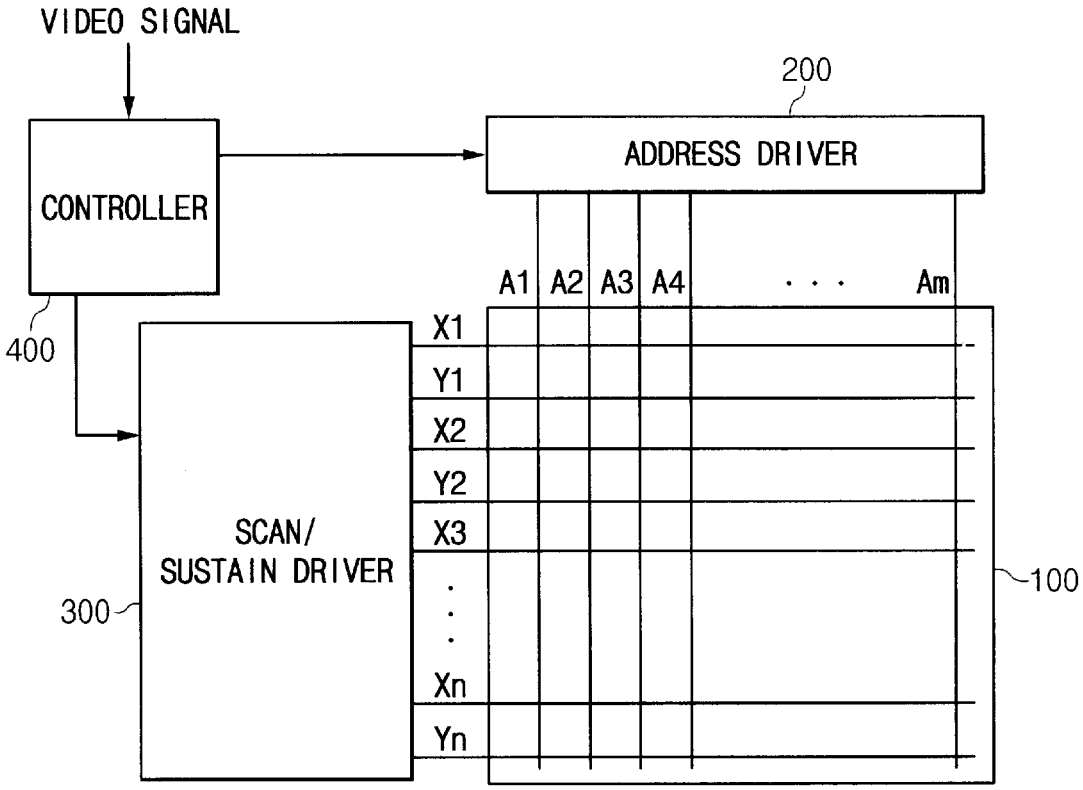
FIG. 2 is an illustration of a PDP according to an embodiment of the present invention.

FIG. 2 is an illustration of the PDP according to an embodiment of the present invention. The PDP includes plasma panel 100, address driver 200, scan/sustain driver 300, and controller 400.

Plasma panel 100 includes a plurality of address electrodes $A_1$ to $A_m$ arranged in columns and a plurality of scan electrodes $Y_1$ to $Y_n$ and sustain electrodes $X_1$ to $X_n$ alternately arranged in rows. Controller 400 receives an external image signal (e.g., a video signal), and generates an address drive control signal and a sustain discharge signal and applies them to address driver 200 and scan/sustain driver 300, respectively.

Address driver 200 receives the address drive control signal from controller 400 and applies a display data signal for selection of discharge cells to be displayed to the individual address electrodes. Scan/sustain driver 300 receives the sustain discharge signal from controller 400 and applies a sustain pulse voltage alternately to the scan and sustain electrodes for a sustain discharge on the selected discharge cells. Address driver 200 and scan/sustain driver 300 include a driver circuit (i.e., a power recovery circuit) for recovering reactive power and reusing it.

Figure 3:
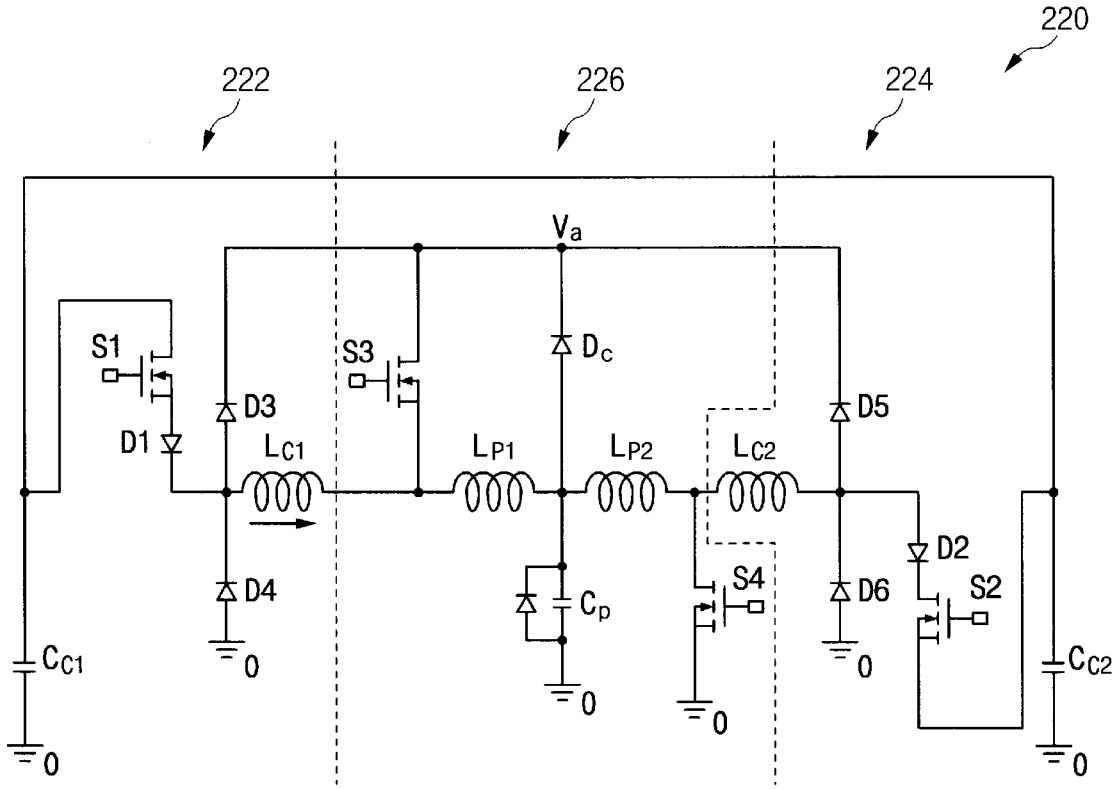
FIG. 3 is a circuit diagram of an address driver according to an embodiment of the present invention.
Figure 5:
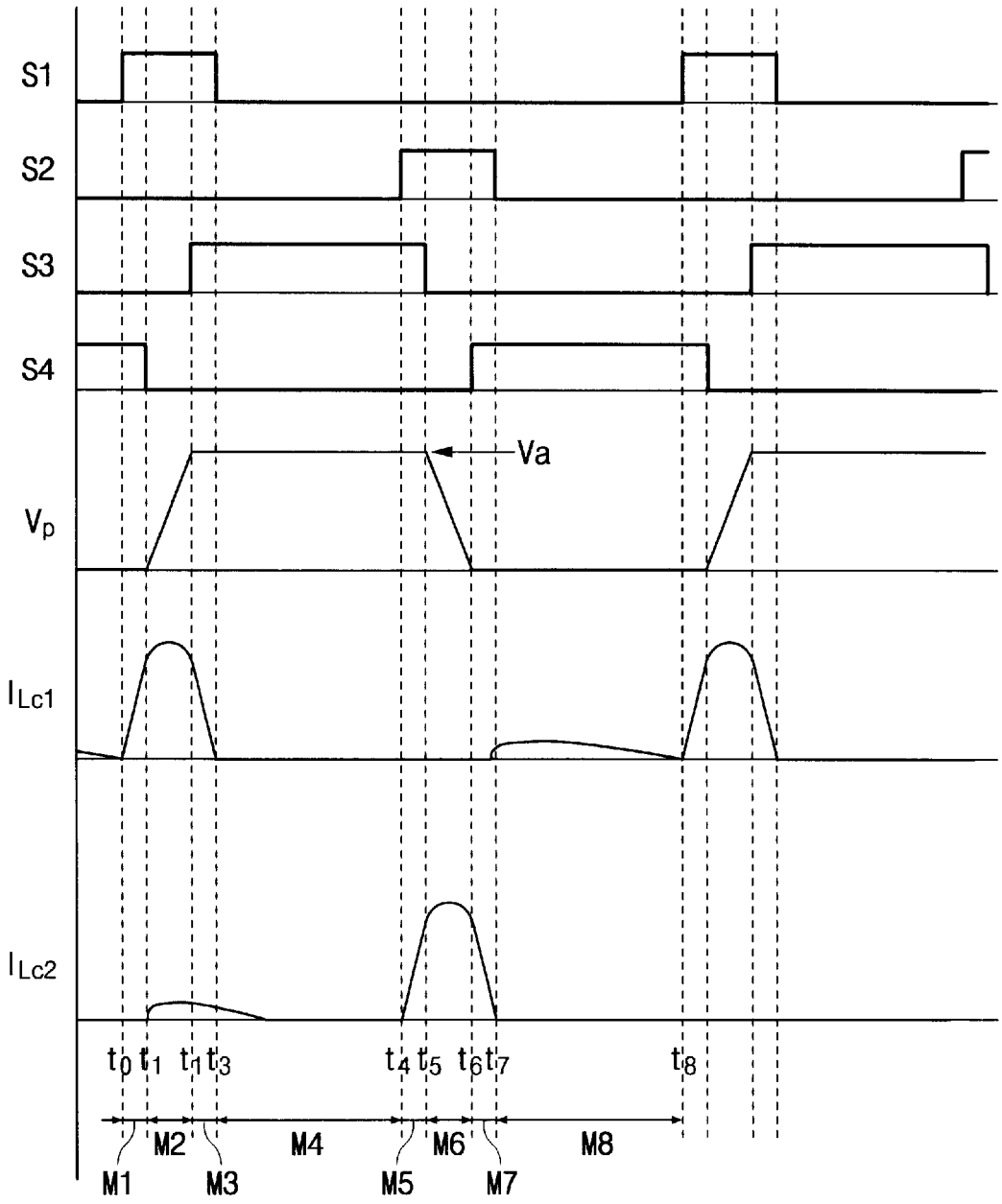
FIG. 5 is a timing diagram of the PDP according to the embodiment of the present invention.
Figure 6:
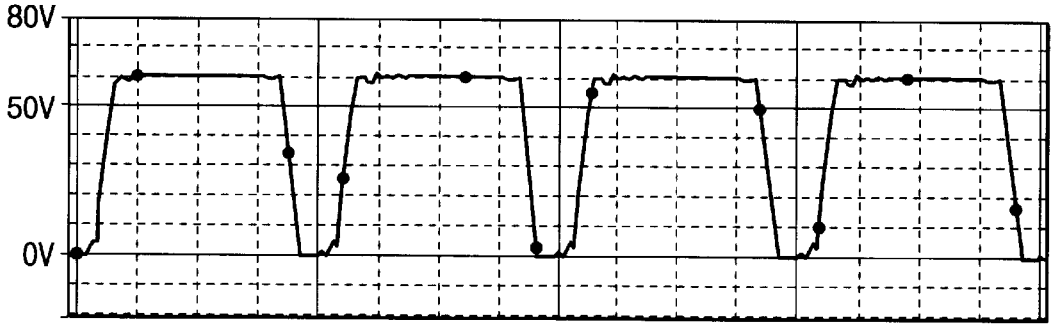
FIG. 6 is an illustration showing an address-driving waveform measured according to an embodiment of the present invention.

Hereinafter, a description will be given as to the address driver according to the embodiment of the present invention with reference to FIGS. 3 to 6. FIG. 3 is a circuit diagram of the address driver according to an embodiment of the present invention. FIGS. 4A to 4H are illustrations showing the current paths in the respective modes according to an embodiment of the present invention. FIG. 5 is a timing diagram of the PDP according to the embodiment of the present invention. FIG. 6 is an illustration showing an address-driving waveform measured according to an embodiment of the present invention.

The power recovery circuit of address driver 200 according to the embodiment of the present invention is coupled to address electrodes $A_1$ to $A_m$ via a plurality of address buffer ICs, and the output pattern coupled to the address buffer ICs acts as a parasitic inductance component. Address electrodes $A_1$ to $A_m$ together with other electrodes $X_1$ to $X_n$ and $Y_1$ to $Y_n$ function as a capacitive load, which is usually denoted as a panel capacitor $C_p$. Here, the address buffer ICs apply the voltage for addressing in the power recovery circuit only to the selected discharge cells.

Expediently, in FIG. 3, the address buffer ICs are not shown and the parasitic inductance component is equivalently denoted as parasitic inductors $L_{p1}$ and $L_{p2}$, assuming that address voltage $V_a$ is applied to one panel capacitor. In order to select discharge cells, a voltage is applied to the terminal of the panel capacitor other than that to which address voltage $V_a$ is applied, and said voltage is assumed as ground voltage 0V in FIG. 3

As shown in FIG. 3, power recovery circuit 220 includes voltage rising unit 222, voltage falling unit 224 and power supply section 226.

Voltage rising unit 222 includes inductor $L_{c1}$ coupled to panel capacitor $C_p$ via parasitic inductor $L_{p1}$, and switch $S_1$ and capacitor $C_{c1}$ coupled in series between inductor $L_{c1}$ and the ground terminal. Voltage rising unit 222 may further include diode $D_1$ that determines a current path on the path formed with inductor $L_{c1}$ and switch $S_1$.

Likewise, voltage falling unit 224 includes inductor $L_{c2}$ coupled to panel capacitor $C_p$ via parasitic inductor $L_{p2}$, and switch $S_2$ and capacitor $C_{c2}$ coupled in series between inductor $L_{c2}$ and the ground terminal. Voltage falling unit 224 may further include diode $D_2$ that determines a current path on the path formed with inductor $L_{c2}$ and switch $S_2$.

Voltage rising unit 222 and voltage falling unit 224 may respectively further include diodes $D_3$ and $D_4$ and diodes $D_5$ and $D_6$ that determine the current path. Diode $D_3$ is coupled between power source $V_a$ for supplying address voltage $V_a$ and a contact between inductor $L_{c1}$ and switch $S_1$. Diode $D_4$ is connected between the ground terminal and the contact between inductor $L_{c1}$ and switch $S_1$. Diode $D_5$ is connected between power source $V_a$ and a contact between inductor $L_{c2}$ and switch $S_2$. Diode $D_6$ is connected between the ground terminal and the contact between inductor $L_{c2}$ and switch $S_2$.

A contact between switch $S_1$ and capacitor $C_{c1}$ in the voltage rising unit 222 is coupled to a contact between switch $S_2$ and capacitor $C_{c2}$ in voltage falling unit 224. Between panel capacitor $C_p$ and power source $V_a$ may be formed clamping diode $D_c$, which prevents the voltage of panel capacitor $C_p$ from exceeding address voltage $V_a$ in the actual circuit.

Power supply section 226 includes switches $S_3$ and $S_4$. Switch $S_3$ is coupled between power source $V_a$ and panel capacitor $C_p$ via parasitic inductor $L_{p1}$. Switch $S_4$ is coupled between the ground terminal and panel capacitor $C_p$ via parasitic inductor $L_{p2}$.

Switches $S_1$, $S_2$, $S_3$, and $S_4$ included in voltage rising unit 222, voltage falling unit 224, and power supply section 226 may include transistors such as MOSFETs, and each has a body diode.

Now, a sequential change of the operation of power recovery circuit 220 according to the embodiment of the present invention will be described with reference to FIGS. 4A to 4H, 5, and 6. The operation proceeds in the order of eight modes M1 to M8 by the manipulation of switches $S_1$ to $S_4$. The phenomenon called "LC resonance" hereinafter is not a continuous oscillation but a change in voltage and current caused by the combination of the inductors, the parasitic inductors, and panel capacitor $C_p$ when switches $S_1$ and $S_2$ are turned on.

In the embodiment of the present invention, it is assumed that before the start of Mode 1, capacitors $C_{c1}$ and $C_{c2}$ are charged to voltage $V_a/2$ amounting to half of address voltage $V_a$, and that switch $S_4$ is turned on to sustain voltage $V_p$ between both terminals of panel capacitor $C_p$ at 0V.

(1) Mode 1 (M1)

Figure 4A:
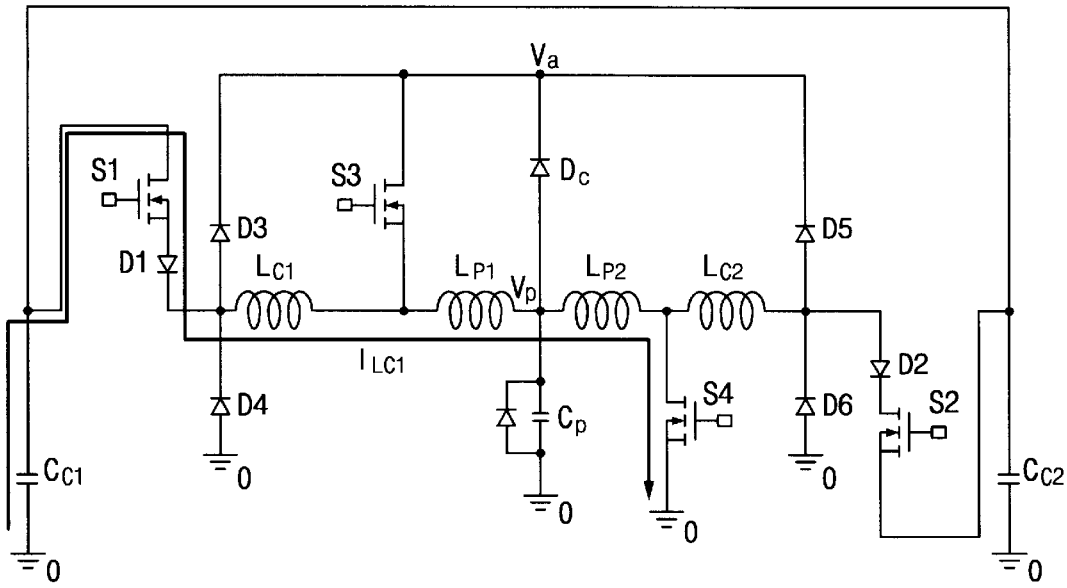
FIGS. 4A to 4H are illustrations showing the current paths in the respective modes according to an embodiment of the present invention.

Reference will be made to FIG. 4A and the M1 interval of FIG. 5 to describe the operation in Mode 1.

In Mode 1, with switch $S_4$ on, switch $S_1$ is turned on to form a current path that includes capacitor $C_{c1}$, switch $S_1$, diode $D_1$, inductor $L_{c1}$, parasitic inductors $L_{p1}$ and $L_{p2}$, and switch $S_4$. Current $I_{LC1}$ flowing to inductor $L_{c1}$ linearly increases due to voltage $V_a/2$ charged on capacitor $C_{c1}$. Hence the energy is stored in inductor $L_{c1}$. This current flows to parasitic inductors $L_{p1}$ and $L_{p2}$ as well and the energy is also stored in parasitic inductors $L_{p1}$ and $L_{p2}$.

(2) Mode 2 (M2)

Figure 4B:
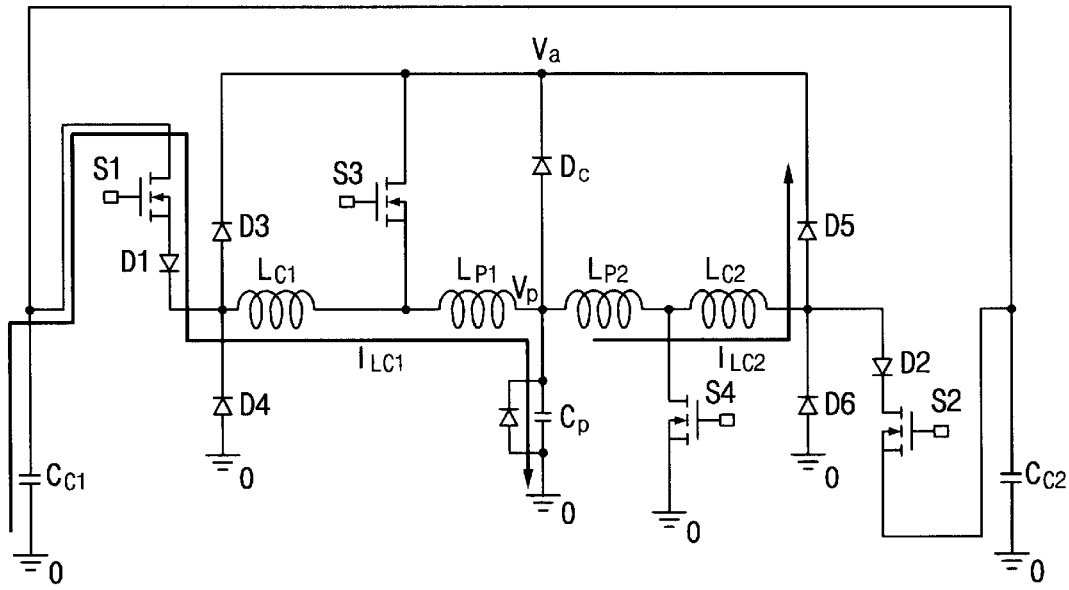

Reference will be made to FIG. 4B and the M2 interval of FIG. 5 to describe the operation in Mode 2.

In Mode 2, with switch $S_1$ on, switch $S_4$ is turned off to form a current path that includes capacitor $C_{c1}$, switch $S_1$, diode $D_1$, inductor $L_{c1}$, parasitic inductor $L_{p1}$, and panel capacitor $C_p$. Due to the LC resonance formed on the current path, a resonance current flows to inductor $L_{c1}$ and terminal voltage $V_p$ of panel capacitor $C_p$ (hereinafter referred to as "panel terminal voltage") increases to address voltage $V_a$. The energy stored in inductor $L_{c1}$ and parasitic inductor $L_{p1}$ makes panel terminal voltage $V_p$ increase to address voltage $V_a$ stably despite the effect of the parasitic component.

Current $I_{LC2}$ flowing to parasitic inductor $L_{p2}$ is recovered to power source $V_a$ via inductor $L_{c2}$ and diode $D_5$.

(3) Mode 3 (M3)

Figure 4C:
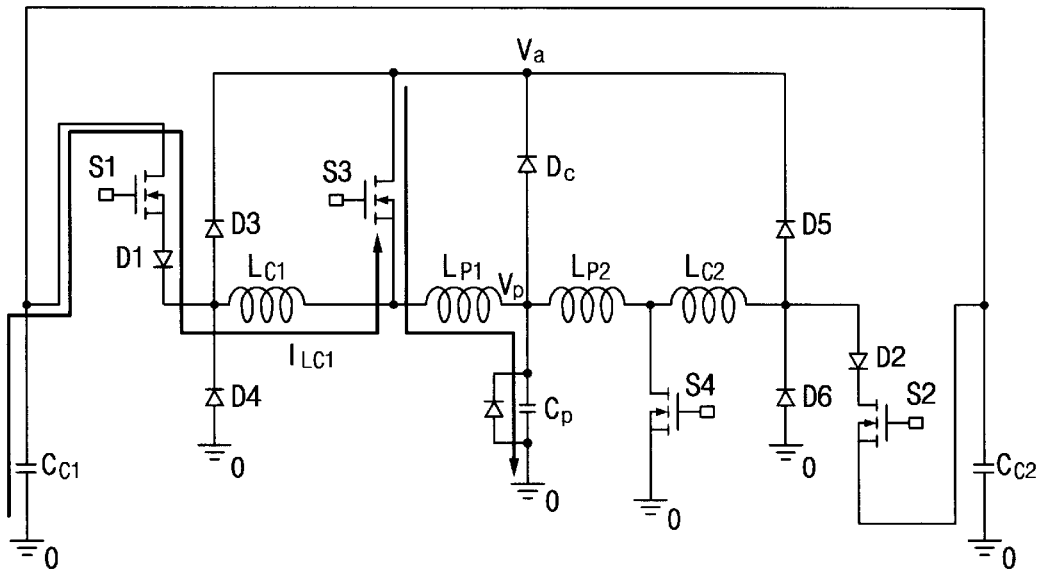

Reference will be made to FIG. 4C and the M3 interval of FIG. 5 to describe the operation in Mode 3.

The panel terminal voltage $V_p$ cannot exceed address voltage $V_a$ due to the body diode of switch $S_3$. When panel terminal voltage $V_p$ reaches address voltage $V_a$, switch $S_3$ is turned on. With switch $S_3$ on, panel terminal voltage $V_p$ is sustained at address voltage $V_a$ due to power source $V_a$. Current $I_{LC1}$ flowing to inductor $L_{c1}$ linearly decreases to 0A through a current path that includes capacitor $C_{c1}$, switch $S_1$, diode $D_1$, inductor $L_{c1}$, and the body diode of switch $S_3$. Namely, this current is recovered to power source $V_a$.

(4) Mode 4 (M4)

Figure 4D:
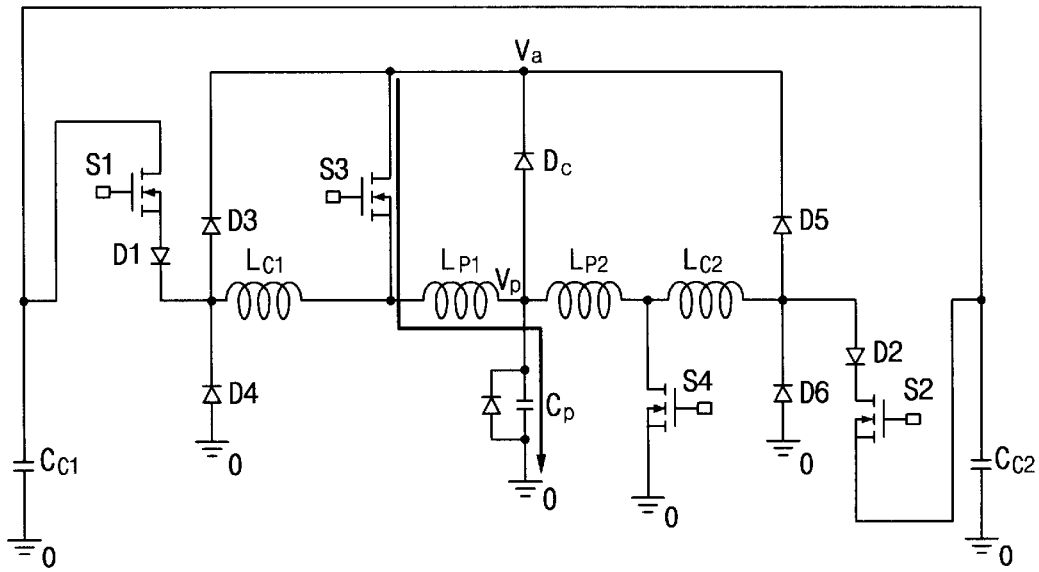

Reference will be made to FIG. 4D and the M4 interval of FIG. 5 to describe the operation in Mode 4.

In Mode 4, switch $S_1$ is turned off when current $I_{LC1}$ flowing to inductor $L_{c1}$ is decreased to 0A. Because switch $S_3$ is in the "on" position at this time, panel terminal voltage $V_p$ is sustained at address voltage $V_a$ due to power source $V_a$.

(5) Mode 5 (M5)

Figure 4E:
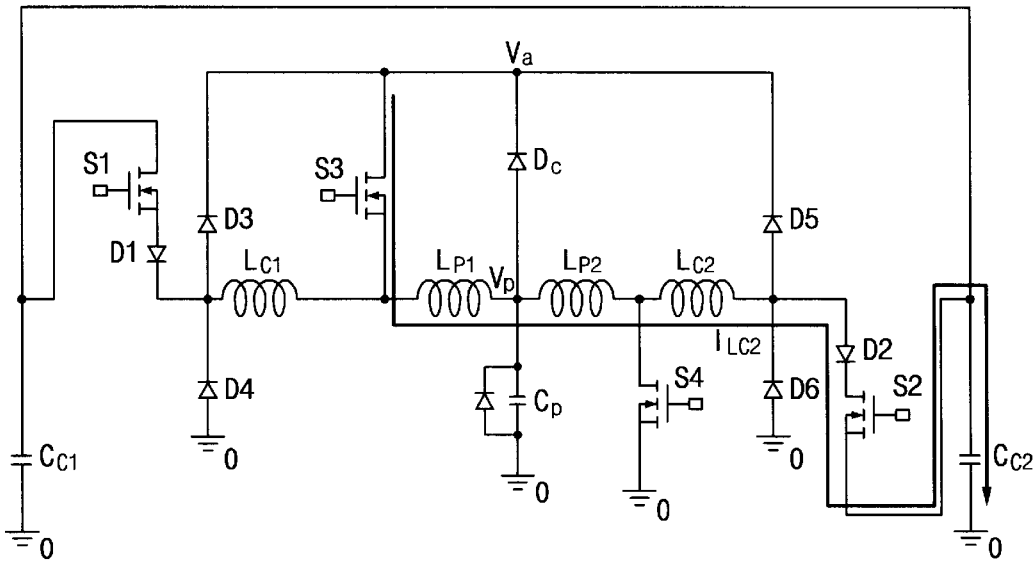

Reference will be made to FIG. 4E and the M5 interval of FIG. 5 to describe the operation in Mode 5.

In Mode 5, with switch $S_3$ on, switch $S_2$ is turned on to form a current path that includes switch $S_3$, parasitic inductors $L_{p1}$ and $L_{p2}$, inductor $L_{c2}$, diode $D_2$, switch $S_2$, and capacitor $C_{c2}$. Due to the difference between power source $V_a$ and voltage $V_a/2$ charged on capacitor $C_{c2}$, current $I_{LC2}$ flowing to inductor $L_{c2}$ linearly increases. Thus the energy is stored in inductor $L_{c2}$. This current flows to parasitic inductors $L_{p1}$ and $L_{p2}$ as well and the energy is also stored in parasitic inductors $L_{p1}$ and $L_{p2}$.

(6) Mode 6 (M6)

Figure 4F:
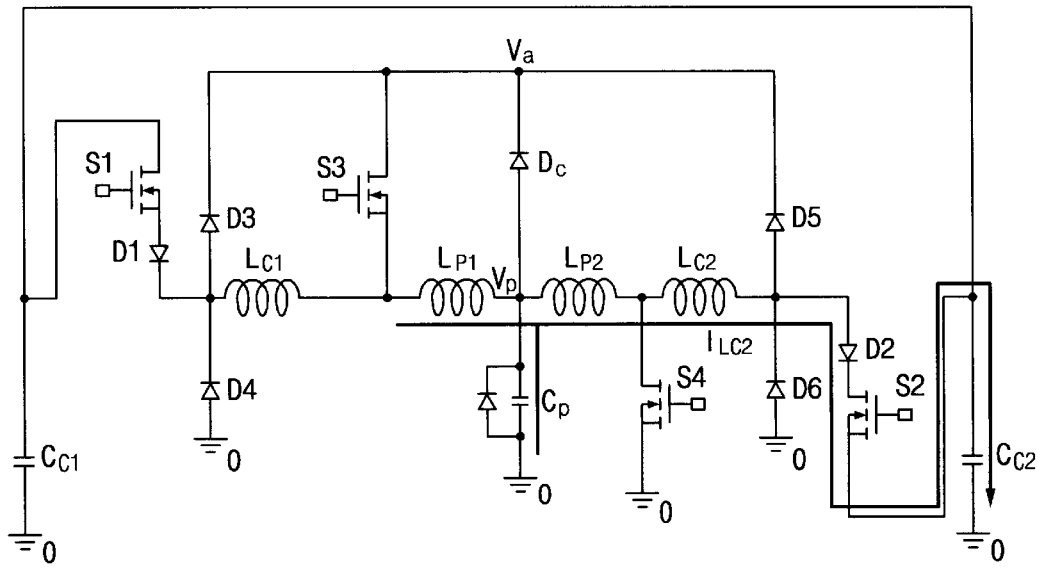

Reference will be made to FIG. 4F and the M6 interval of FIG. 5 to describe the operation in Mode 6.

In Mode 6, with switch $S_2$ on, switch $S_3$ is turned off to form a current path that includes panel capacitor $C_p$, parasitic inductor $L_{p2}$, inductor $L_{c2}$, diode $D_2$, switch $S_2$, and capacitor $C_{c2}$. Due to the LC resonance formed on the current path, a resonance current flows to inductor $L_{c2}$ and panel terminal voltage $V_P$ of panel capacitor $C_p$ decreases to 0V. The energy stored in inductor $L_{c2}$ and parasitic inductor $L_{p2}$ makes panel terminal voltage $V_p$ decrease to 0V stably despite the effect of the parasitic component.

(7) Mode 7 (M7)

Figure 4G:
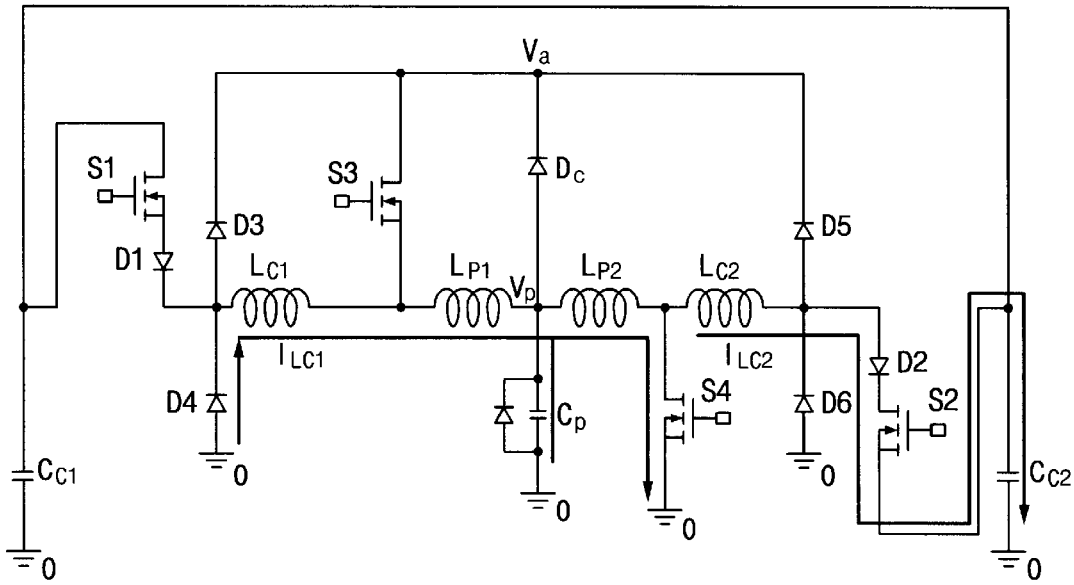

Reference will be made to FIG. 4G and the M7 interval of FIG. 5 to describe the operation in Mode 7.

Panel terminal voltage $V_p$ cannot drop below the ground voltage due to the body diode of switch $S_4$. When panel terminal voltage $V_p$ reaches the ground voltage, switch $S_4$ is turned on. With switch $S_4$ on, panel terminal voltage $V_p$ is sustained at 0V. Current $I_{L2}$ flowing to inductor $L_{c2}$ linearly decreases to 0A through a current path that includes the body diode of switch $S_4$, inductor $L_{c2}$, diode $D_2$, switch $S_2$, and capacitor $C_{c2}$. Namely, this current is recovered to capacitor $C_{c2}$.

(8) Mode 8 (M8)

Figure 4H:
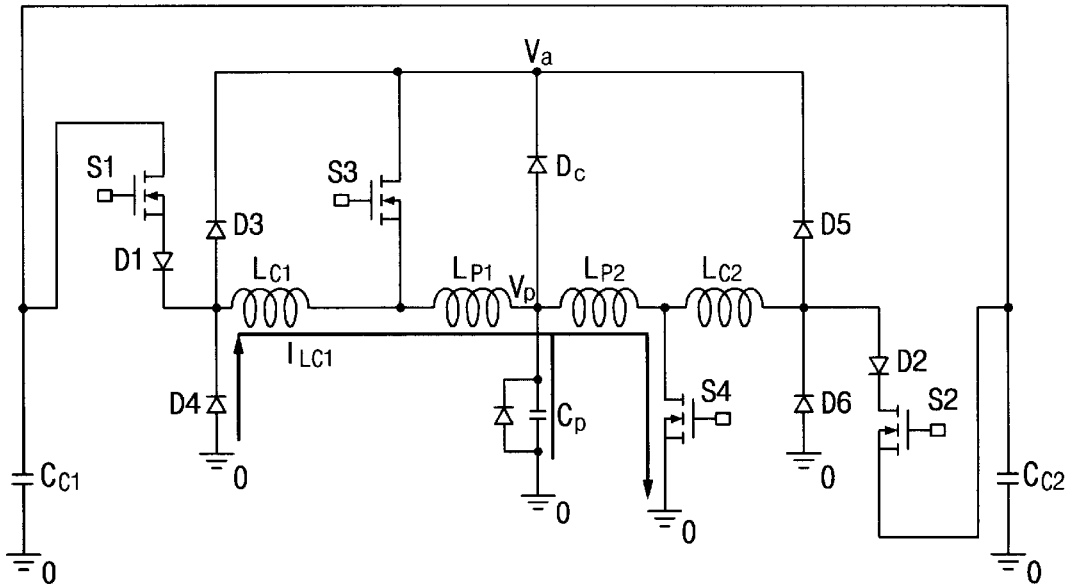

Reference will be made to FIG. 4H and the M8 interval of FIG. 5 to describe the operation in Mode 8.

In Mode 8, switch $S_2$ is turned off when current $I_{LC2}$ flowing to inductor $L_{c2}$ is decreased to 0A. Because switch $S_4$ is in the "on" position at this time, panel terminal voltage $V_p$ is sustained at 0V due to the ground terminal.

As described above, in the embodiment of the present invention, the energy is not only stored in inductors $L_{c1}$ and $L_{c2}$ in Mode 1 and Mode 5, respective, but also in parasitic inductors $L_{p1}$ and $L_{p2}$, and it is used to change the panel terminal voltage thereby reducing a distortion caused by the parasitic inductance component. An actual experiment reveals, as shown in FIG. 6, that a rise pulse hardly occurs in the rise and drop intervals of the address-driving waveform.

It is impossible to form a current path of a different direction in the ground voltage interval between drop and rise intervals of panel terminal voltage $V_p$, because the ground voltage interval is short as is characteristic of the address-driving waveform. According to the embodiment of the present invention, however, the direction of the current flowing to inductors $L_{c1}$ and $L_{c2}$ and parasitic inductors $L_{p1}$ and $L_{p2}$ is constant at any time. This facilitates the rise/drop operation of panel terminal voltage $V_p$ despite the shortness of the ground voltage interval.

While this invention has been described in connection with specific embodiments, it is to be understood that the invention is not limited to the disclosed embodiments, but, on the contrary, is intended to cover various modifications and equivalent arrangements included within the spirit and scope of the appended claims.

What is claimed is:

1. An apparatus for driving a plasma display panel having a panel capacitor with an address-driving waveform applied thereto, the apparatus comprising:

a first inductor and a second inductor, each having one terminal thereof coupled to both terminals of a path coupled to one terminal of the panel capacitor;

a first switch and a first capacitor coupled in series between an other terminal of the first inductor and a first power source supplying a first voltage;

a second switch and a second capacitor coupled in series between an other terminal of the second inductor and the first power source;

a third switch coupled between a second power source for supplying a second voltage and the one terminal of the first inductor; and a fourth switch coupled between the one terminal of the second inductor and the first power source, wherein the first capacitor and the second capacitor are charged to a voltage substantially corresponding to half of the second voltage.

2. The apparatus as claimed in claim 1, wherein a parasitic inductance component is formed on the path.

3. The apparatus as claimed in claim 1, further comprising:

a first diode formed on a path including the first switch and the first inductor; and a second diode formed on a path including the second switch and the second inductor.

4. The apparatus as claimed in claim 1, further comprising:

a first diode coupled between the first power source and the other terminal of the first inductor; and a second diode coupled between the other terminal of the second inductor and the second power source.

5. The apparatus as claimed in claim 1, wherein the third switch and the fourth switch include a body diode.

6. An apparatus for driving a plasma display panel having a panel capacitor with an address-driving waveform applied thereto, the apparatus comprising:

a first voltage changer including a first inductor coupled to one terminal of a path coupled to one terminal of the panel capacitor, the first voltage changer storing energy in the first inductor through a current path formed from the first inductor to the one terminal of the panel capacitor while a terminal voltage of the panel capacitor is sustained at a first voltage, the first voltage changer changing the terminal voltage of the panel capacitor to a second voltage using the energy stored in the first inductor and a resonance;

a second voltage changer including a second inductor coupled to the other terminal of the path, the second voltage changer storing energy in the second inductor through a current path formed from the one terminal of the panel capacitor to the second inductor while the terminal voltage of the panel capacitor is sustained at the second voltage, the second voltage changer changing the terminal voltage of the panel capacitor to the first voltage using the energy stored in the second inductor and the resonance; and a power supply section including first and second power sources, the first power source supplying the first voltage and sustaining the terminal voltage of the panel capacitor at the first voltage, the second power source supplying the second voltage and sustaining the terminal voltage of the panel capacitor at the second voltage.

7. The apparatus as claimed in claim 6, wherein a parasitic inductance component is formed on the path.

8. The apparatus as claimed in claim 6, wherein the power supply section provides a first path for recovering a current flowing to the first inductor, and a second path for recovering a current flowing to the second inductor.

9. The apparatus as claimed in claim 6, wherein the power supply section further includes:

a first switch performing a switching operation to sustain the terminal voltage of the panel capacitor at the second voltage and having a body diode, a current flowing to the first inductor being recovered through the body diode of the first switch; and a second switch performing a switching operation to sustain the terminal voltage of the panel capacitor at the first voltage and having a body diode, a current flowing to the second inductor being recovered through the body diode of the second switch.

10. The apparatus as claimed in claim 6, wherein the first voltage changer further includes a first capacitor charged to a third voltage substantially corresponding to half of the difference between the second voltage and the first voltage, wherein the second voltage changer further includes a second capacitor charged to the third voltage.

11. The apparatus as claimed in claim 10, wherein the first voltage changer further includes a first switch being coupled between the first inductor and the first capacitor and performing a switching operation to flow a current to the first inductor, wherein the second voltage changer further includes a second switch being coupled between the second inductor and the second capacitor and performing a switching operation to flow a current to the second inductor.

12. A method for driving a plasma display panel, which includes a panel capacitor, the method comprising:

storing energy in a first inductor coupled to one terminal of a path coupled to one terminal of the panel capacitor, while a terminal voltage of the panel capacitor is sustained at a first voltage;

changing the terminal voltage of the panel capacitor to a second voltage using the energy stored in the first inductor and a resonance;

recovering a current flowing to the first inductor while sustaining the terminal voltage of the panel capacitor at the second voltage;

storing energy in a second inductor coupled to the other terminal of the path, while the terminal voltage of the panel capacitor is sustained at the second voltage;

changing the terminal voltage of the panel capacitor to the first voltage using the energy stored in the second inductor and the resonance; and recovering a current flowing to the second inductor while sustaining the terminal voltage of the panel capacitor at the first voltage.

13. The method as claimed in claim 12, wherein storing energy in a first inductor includes using a first capacitor charged to a third voltage substantially corresponding to half of the difference between the second voltage and the first voltage, wherein storing energy in the second inductor includes using the difference between the second voltage and the third voltage charged on a second capacitor.

14. The method as claimed in claim 12, wherein sustaining the terminal voltage of the panel capacitor at the second voltage includes using a power source for supplying the second voltage; and current flowing to the first inductor is recovered through a path formed between the first inductor and the power source.

15. The method as claimed in claim 12, wherein sustaining the terminal voltage of the panel capacitor at the first voltage includes using a power source for supplying the first voltage; and current flowing to the second inductor is recovered through a path formed between the power source and the second inductor.

16. An apparatus for driving a plasma display panel having a panel capacitor coupled on a lengthwise conductive pattern and an address-driving waveform applied to the panel capacitor, the apparatus comprising:

a first inductor and a second inductor, each having one terminal thereof coupled to both terminals of the conductive pattern;

a first current path formed to flow a first current through the first inductor and the conductive pattern;

a second current path formed to cause a resonance of the first inductor and the panel capacitor while the first current flows, and to change a voltage of the panel capacitor to a first voltage due to the resonance;

a third current path formed to recover a current remaining in the first inductor while the voltage of the panel capacitor is sustained at the first voltage;

a fourth current path formed to flow a second current through the conductive pattern and the second inductor;

a fifth current path formed to cause a resonance of the second inductor and the panel capacitor while the second current flows, and to change the voltage of the panel capacitor to a second voltage due to the resonance; and a sixth current path formed to recover a current remaining in the second inductor while the voltage of the panel capacitor is sustained at the second voltage.

17. The apparatus as claimed in claim 16, wherein the first current and the second current flow in a same direction on the conductive pattern.

18. The apparatus as claimed in claim 16, wherein the first current path allows a current of a same direction as the first current to flow to a parasitic inductance component formed on the conductive pattern, and wherein the second current path causes the resonance on the panel capacitor and a part of the parasitic inductance component.

19. A plasma display panel apparatus, comprising:

a plasma panel having a plurality of address electrodes arranged in columns and a plurality of scan electrodes and sustain electrodes alternately arranged in rows, the address electrodes, scan electrodes and sustain electrodes collectively forming a panel capacitor;

a scan/sustain driver coupled to the plurality of scan electrodes and sustain electrodes;

an address drive coupled to the plurality of address electrodes; and a controller responsive to an external image signal to generate an address drive control signal to the address driver and to generate a sustain discharge signal to the scan/sustain driver, the address driver applying a display data signal for selection of discharge cells to be displayed to individual address electrodes, the scan/sustain driver applying a sustain pulse voltage alternately to the scan and sustain electrodes for a sustain discharge on the selected discharge cells;

wherein the address driver or the scan/sustain driver includes a power recovery circuit coupled to the address electrodes or scan/sustain electrodes for recovering and reusing reactive power, the power recovery circuit including:

a first inductor and a second inductor, each having one terminal thereof coupled to both terminals of a path coupled to one terminal of the panel capacitor;

a first switch and a first capacitor coupled in series between an other terminal of the first inductor and a first power source supplying a first voltage;

a second switch and a second capacitor coupled in series between an other terminal of the second inductor and the first power source;

a third switch coupled between a second power source for supplying a second voltage and the one terminal of the first inductor; and a fourth switch coupled between the one terminal of the second inductor and the first power source, wherein the first capacitor and the second capacitor are charged to a voltage substantially corresponding to half of the second voltage.

20. A plasma display panel apparatus, comprising:

a plasma panel having a plurality of address electrodes arranged in columns and a plurality of scan electrodes and sustain electrodes alternately arranged in rows, the address electrodes, scan electrodes and sustain electrodes collectively forming a panel capacitor;

a scan/sustain driver coupled to the plurality of scan electrodes and sustain electrodes;

an address drive coupled to the plurality of address electrodes; and a controller responsive to an external image signal to generate an address drive control signal to the address driver and to generate a sustain discharge signal to the scan/sustain driver, the address driver applying a display data signal for selection of discharge cells to be displayed to individual address electrodes, the scan/sustain driver applying a sustain pulse voltage alternately to the scan and sustain electrodes for a sustain discharge on the selected discharge cells;

wherein the address driver or the scan/sustain driver includes a power recovery circuit coupled to the address electrodes or scan/sustain electrodes for recovering and reusing reactive power, the power recovery circuit including:

a first voltage changer including a first inductor coupled to one terminal of a path coupled to one terminal of the panel capacitor, the first voltage changer storing energy in the first inductor through a current path formed from the first inductor to the one terminal of the panel capacitor while a terminal voltage of the panel capacitor is sustained at a first voltage, the first voltage changer changing the terminal voltage of the panel capacitor to a second voltage using the energy stored in the first inductor and a resonance;

a second voltage changer including a second inductor coupled to the other terminal of the path, the second voltage changer storing energy in the second inductor through a current path formed from the one terminal of the panel capacitor to the second inductor while the terminal voltage of the panel capacitor is sustained at the second voltage, the second voltage changer changing the terminal voltage of the panel capacitor to the first voltage using the energy stored in the second inductor and the resonance; and a power supply section including first and second power sources, the first power source supplying the first voltage and sustaining the terminal voltage of the panel capacitor at the first voltage, the second power source supplying the second voltage and sustaining the terminal voltage of the panel capacitor at the second voltage.

* * * * *